US005763145A

United States Patent [19]

Ling

[11] Patent Number: 5,763,145

[45] Date of Patent: Jun. 9, 1998

[54] PHOTOGRAPHIC ELEMENT CONTAINING A REDUCTONE AND, IN THE MOST BLUE LIGHT SENSITIVE LAYER, A FINE GRAIN EMULSION

[75] Inventor: Hans G. Ling, Rochester, N.Y.

[73] Assignee: Eastman Kodak Company, Rochester, N.Y.

[21] Appl. No.: 753,665

[22] Filed: Nov. 27, 1996

[51] Int. Cl.[6] ..... G03C 7/46

[52] U.S. Cl. ..... 430/375; 430/448; 430/434; 430/442; 430/464; 430/486; 430/564; 430/566; 430/567; 430/506

[58] Field of Search ..... 430/448, 434, 430/442, 464, 486, 564, 566, 567, 506, 375

[56] References Cited

U.S. PATENT DOCUMENTS

| | | | |
|---|---|---|---|
| 3,672,896 | 6/1972 | Gabrielsen et al. | 430/448 |
| 3,690,872 | 9/1972 | Gabrielsen et al. | 430/448 |
| 3,700,442 | 10/1972 | Gabrielsen et al. | 430/564 |
| 3,816,137 | 6/1974 | Gabrielsen et al. | 430/566 |

*Primary Examiner*—Geraldine Letscher
*Attorney, Agent, or Firm*—Arthur E. Kluegel

[57] ABSTRACT

The invention provides a multicolor photographic element comprising a support bearing at least two silver halide emulsion layers having different sensitivities to blue light, a silver halide emulsion layer sensitive to green light, and a silver halide emulsion layer sensitive to red light, wherein:

(1) the element comprises a compound of formula (I):

(I)

wherein $R_1$ and $R_2$, independently represent H, an alkyl group or an aryl group, provided that $R_1$ and $R_2$ may be joined to form a ring;

$R_3$ is selected from the group consisting of H, alkyl, aryl, and acyl groups;

$R_4$ and $R_5$ are independently selected from the group consisting of H, OH, alkyl, and aryl groups;

n is 1 or 2;

and (2) the silver halide emulsion layer of the element that is most sensitive to blue light contains a silver halide grain population such that from 3 to 20 wt % of the total silver halide grains in the emulsion layer have a size (equivalent circular diameter) less than 0.2 micrometers.

The element exhibits an improved combination of blue speed, raw stock keeping, and latent image keeping.

15 Claims, No Drawings

PHOTOGRAPHIC ELEMENT CONTAINING A REDUCTONE AND, IN THE MOST BLUE LIGHT SENSITIVE LAYER, A FINE GRAIN EMULSION

FIELD OF THE INVENTION

The invention relates to multicolor photographic elements and more particularly to such elements containing a reductone and, in the most blue sensitive layer, a silver halide emulsion wherein from 3 to 20 wt % of the total silver halide grains in the emulsion layer have a size (equivalent circular diameter) less than 0.2 micrometers.

BACKGROUND OF THE INVENTION

U.S. Pat. No. 2,936,308 of John E. Hodge discloses the class of compounds known as "reductones". According to the patent the term generally refers to the class of unsaturated, di- or poly-enolic organic compounds which, by virtue of the arrangement of the enolic hydroxyl groups with respect to the unsaturated linkages, possess strong reducing power. The compounds are generally derived from sugars particularly 6-carbon sugars such as glucose. The reductones are said to be useful as reducing agents for silver and other metals, as antioxidants, photographic developers, and as medicinals.

Piperadinohexosereductone is one example of a reductone taught by the patent and may be represented by the formula:

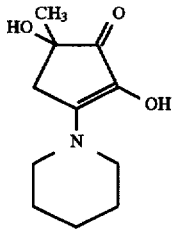

The use of reductone compounds has been known for color print paper stock as a means for improving the keeping of the stock. For such photographic materials, speed is not of concern because the imaging light is readily controlled during processing.

U.S. Pat. No. 3,667,958 of F. Evans et al. suggests the possible inclusion of a reductone in a reducing agent combination in a photographic element to provide greater resolution, an increase in relative speed and improved black tone. The elements are ones which include both oxidizing and reducing agents and are heat (dry) developable rather than wet processed.

The use in photographic elements of very fine grain silver halide emulsions, sometimes referred to as Lippmann Emulsions, has been suggested. T. H. James, *The Theory of the Photographic Process*, 4th ed., pp 100, 418 MacMillan Publishing Co., Inc., New York, N.Y. (1977). Such emulsions are said to have an average grain size of about 0.05 micrometers.

Lippmann Emulsions have been used in various non imaging layers as a means of protecting the imaging layers, during processing, from the contaminants which invariably build up in processing solutions. They have also been used to provide surface physical toughness.

A problem to be solved is to provide a photographic element which exhibits an improved combination of blue speed, raw stock keeping, and latent image keeping.

SUMMARY OF THE INVENTION

The invention provides a multicolor photographic element comprising a support bearing at least two silver halide emulsion layers having different sensitivities to blue light, a silver halide emulsion layer sensitive to green light, and a silver halide emulsion layer sensitive to red light, wherein:

(1) the element comprises a compound of formula (I):

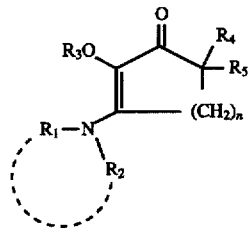

(I)

wherein $R_1$ and $R_2$ independently represent H, an alkyl group or an aryl group, provided that $R_1$ and $R_2$ may be joined to form a ring;

$R_3$ is selected from the group consisting of H, alkyl, aryl, and acyl groups;

$R_4$ and $R_5$ are independently selected from the group consisting of H, OH, alkyl, and aryl groups;

n is 1 or 2;

and (2) the silver halide emulsion layer of the element that is most sensitive to blue light contains a silver halide grain population such that from 3 to 20 wt % of the total silver halide grains in the emulsion layer have a size (equivalent circular diameter) less than 0.2 micrometers.

The invention also contemplates a method of forming an image in the described element.

The photographic element exhibits an improved combination of blue speed, raw stock keeping, and latent image keeping.

DETAILED DESCRIPTION OF THE INVENTION

The element of the invention is generally as described in the Summary of the Invention. The element comprises a compound of formula (I):

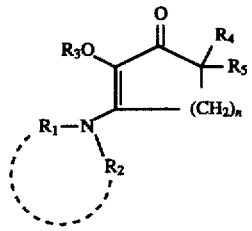

(I)

$R_1$ and $R_2$ independently represent H, an alkyl group or an aryl group, provided that $R_1$ and $R_2$ may be joined to form a ring. Suitable such rings include aziridinyl, azetidinyl, pyrrolidinyl, piperidinyl, morpholinyl, piperazinyl, and pyridinyl. Particular examples are where $R_1$ and $R_2$ are each lower alkyl having 1 to 6 carbon atoms such as methyl and where they join to form a ring such as

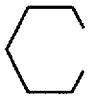

or

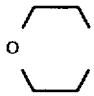

$R_3$ is selected from the group consisting of H, alkyl, aryl, and acyl groups. Suitably $R_3$ is hydrogen but the other alternative substituents may be employed.

$R_4$ and $R_5$ are independently selected from the group consisting of H, OH, alkyl, and aryl groups. Most suitably they are independently OH or lower alkyl such as methyl.

n is 1 or 2 and is preferably 1.

The compounds represented by I-1, I-2, and I-3 hereafter are particularly suitable for use in the invention.

The laydown of the reductone compound of the invention is typically in the range of from 0.001 to 21.5 mg/m$^2$, suitably 0.01 to 16.1 mg/m$^2$, more suitably 0.108 to 10.8 mg/m$^2$, and most suitably 3 to 8 mg/m$^2$. The reductone material may be initially incorporated in any layer of the element, it being understood that this water soluble material will diffuse during film manufacture.

Examples of suitable reductone compounds for use in the invention are:

I-1

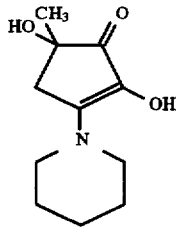

I-2

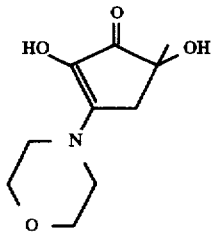

I-3

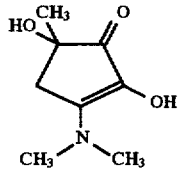

-continued

I-4

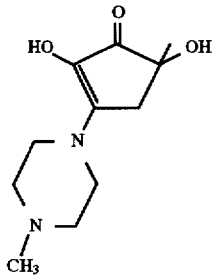

I-5

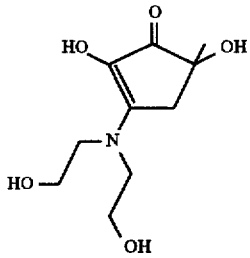

I-6

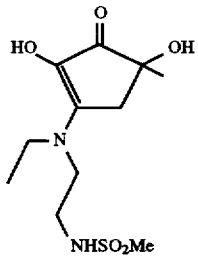

I-7

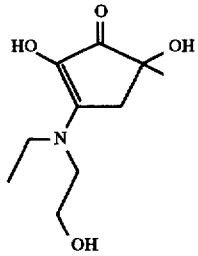

I-8

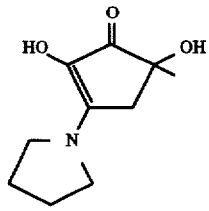

I-9

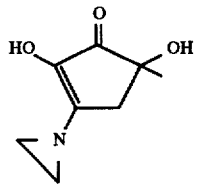

-continued

I-10

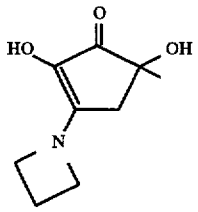

I-11

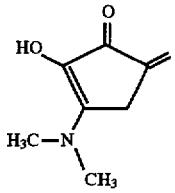

I-12

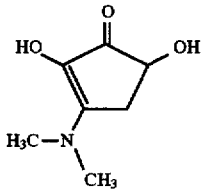

I-13

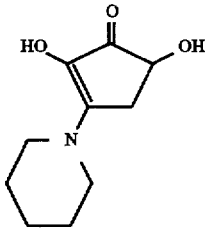

I-14

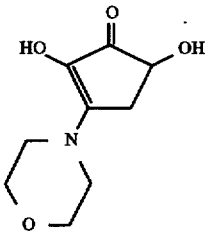

I-15

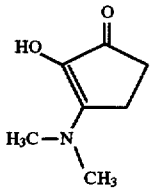

I-16

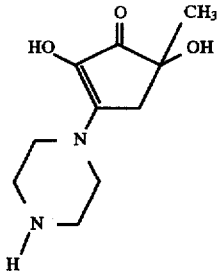

-continued

I-17

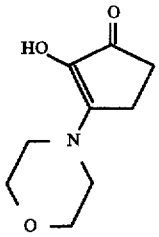

I-18

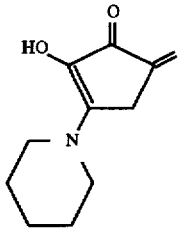

I-19

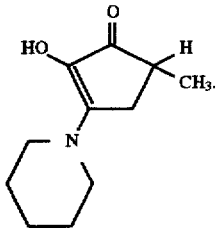

In the element of the invention, the emulsion layer most sensitive to blue light contains a substantial percentage of a very fine grain Lippmann emulsion. These emulsions are described, for example, in *The Theory of the Photo graphic Process* as mentioned in the Background of the Invention and in W. Thomas, Jr., *The SPSE Handbook of Photographic Science and Engineering*, Wiley & Sons, (1973). Such an emulsion comprises a fine grain silver halide such as bromide and/or iodide having an equivalent area circular diameter averaging about 0.05 μm or less with substantially all of the particles being less than 0.2 μm. In particular, the fine grain emulsion is included in the most blue light sensitive layer in an amount so that from 3 to 20 wt % of the total silver halide grains in the layer have a size (equivalent circular diameter) less than 0.2 μm. Suitably, the fine grain is present in an amount of from 5 to 15 wt % of the total grains in the layer.

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido,p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element.

The photographic elements are multicolor elements contain image dye-forming units sensitive to each of the three primary regions of the spectrum. Each unit can comprise one or more emulsion layers sensitive to a given region of the spectrum. The layers of the element, including the layers of the image-forming units, can be arranged in various orders as known in the art.

A typical multicolor photographic element of the invention comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps are described in *Research Disclosure*, Item 37038, February 1995.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl such as oxazolidinyl or hydantoinyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213,490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application 58-113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. No. 4,163,669; U.S. Pat. No. 4,865,956; and U.S. Pat. No. 4,923,784, may be useful. Also contemplated is use of the compositions in association with nucleating agents, development accelerators or their precursors (UK Patent 2,097,140; U.K. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899;

362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science* and *Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

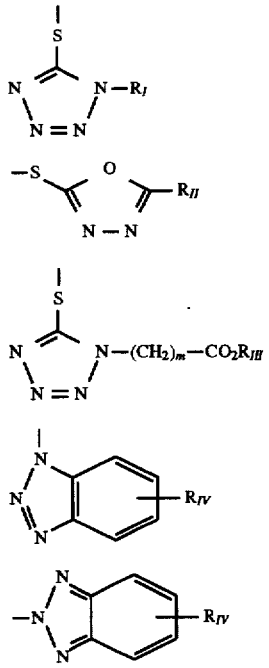

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. Nos. 4,409,323; 4,421,845; Japanese Applications 57-188035; 58-98728; 58-209736; 58-209738) groups utilizing ester hydrolysis (German Patent Application (OLS) No. 2,626,315; groups utilizing the cleavage of imino ketals (U.S. Pat. No. 4,546,073); groups that function as a coupler or reducing agent after the coupler reaction (U.S. Pat. No. 4,438,193; U.S. Pat. No. 4,618,571) and groups that combine the features describe above. It is typical that the timing group or moiety is of one of the formulas:

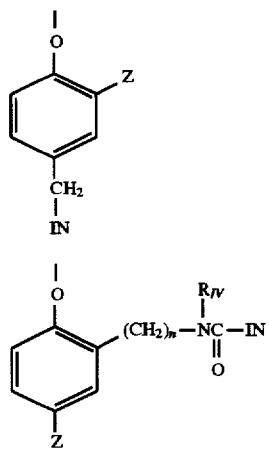

wherein IN is the inhibitor moiety, Z is selected from the group consisting of nitro, cyano, allylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

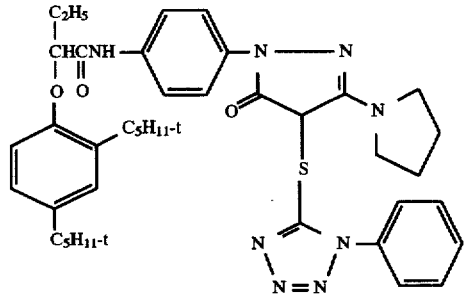

-continued
D2
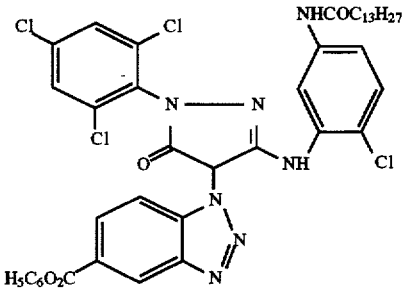
D3
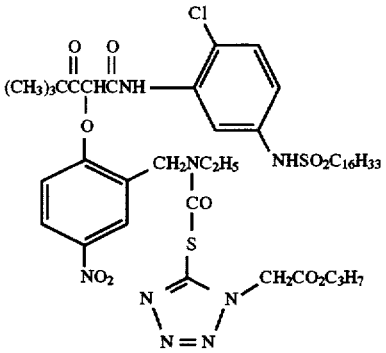
D4
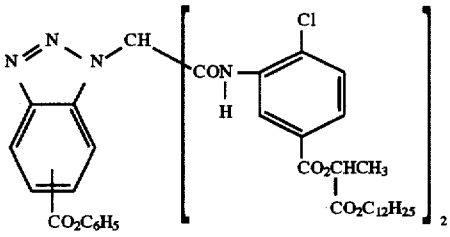
D5
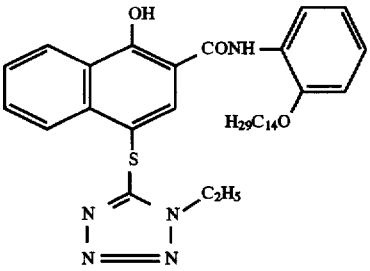
D6
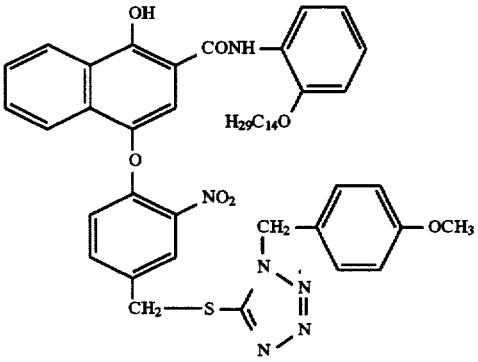
-continued
D7
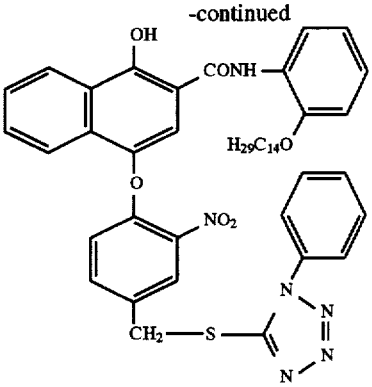
D8
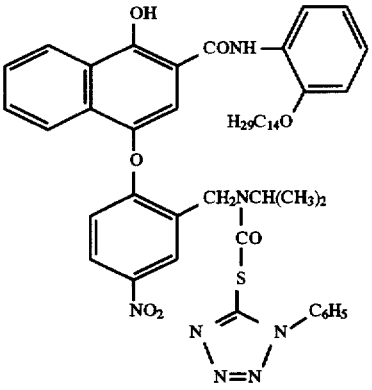
D9
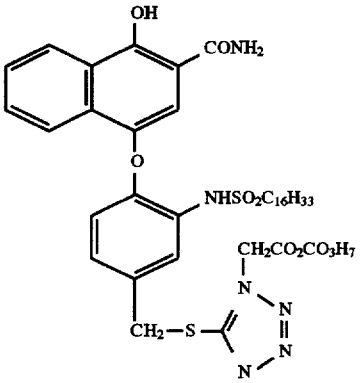
D10
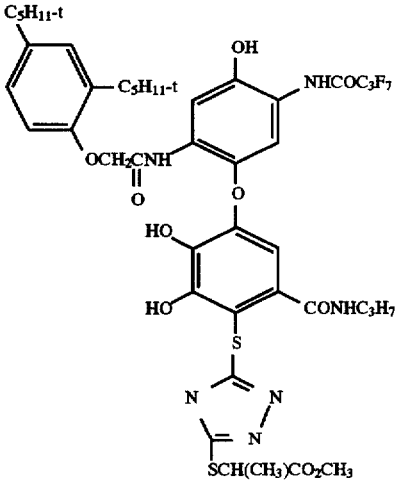

-continued

D11

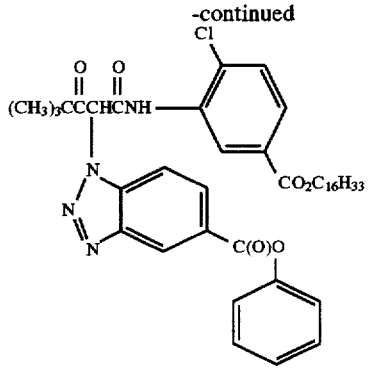

D12

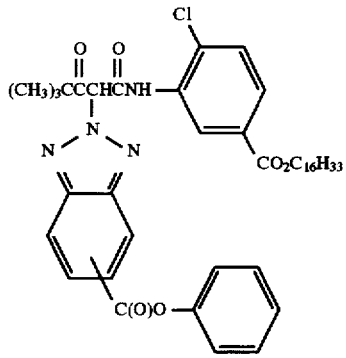

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following: Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions are negative-working emulsions, such as surface-sensitive emulsions or unfogged internal latent image-forming emulsions.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element is designed for image capture and speed (the sensitivity of the element to low light conditions) is often critical to obtaining sufficient image in such elements. When such elements are to be used to generate a color print, they are typically processed in known color negative processes such as the Kodak C-41 process as described in The British Journal of Photography Annual of 1988, pages 191–198. If such an element is to be employed to generate a viewable projection print as for a motion picture, a process such as the Kodak ECN-2 process described in the H-24 Manual available from Eastman Kodak Co. may be employed. Color negative development times are typically 3'15" or less and preferably 90 or even 60 seconds or less.

Color reflection prints may be processed, for example, using the Kodak RA-4 process as described in The British Journal of Photography Annual of 1988, Pp 198–199; color projection prints may be processed, for example, in accordance with the Kodak ECP-2 process as described in the H-24 Manual. Color print development times are typically 90 seconds or less and preferably 45 or even 30 seconds or less.

The above emulsions are typically sold with instructions to process using the appropriate method.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the various copending applications as well as patents and other publications cited in this specification are incorporated herein by reference.

Photographic Examples

Multilayer Used in Examples

The following is a description of the multilayer photographic element which serves as the basis for the examples. The quantities indicated are laydown in g/m$^2$. Emulsion sizes for tabular grain emulsions are determined by the disc centrifuge method and are reported in Diameter×Thickness in micrometers; for 3D grain emulsions, the equivalent circular radius in micrometers is reported. For the very fine grain Lippmann emulsions, EIA (Electron Image Analysis) was used to measure the particle size.

Layer 1 (Antihalation layer): black colloidal silver at 0.108; gelatin at 2.153;

sulfuric acid (0.2N) at 0.0028; Triton X-200® (surfactant (Rohm and Haas) at 0.053; hexasodium salt of metaphosphoric acid at 0.032; disodium salt of 3,5-disulfocatechol at 0.215; Dye-1 at 0.0753; St-1 at 0.161; Cpd-1 at 0.0005; Cpd-2 at 0.0024.

Layer 2 (Slow cyan layer): a blend of two silver iodobromide emulsions sensitized with Dye Set 1 (CSD-1+CSD-2 at 2:1 by wt.): (I) a small tabular emulsion (0.532×0.122, 4.1 mole % I) at 0.560 and (ii) a very small tabular grain emulsion (0.53×0.08, 1.3 mole % I) at 0.538; gelatin at 1.67; cyan dye-forming coupler C-1 at 0.403; bleach accelerator releasing coupler(B-1) at 0.075; and inhibitor releasing coupler (DIR-1) at 0.0151.

Layer 3 (Mid cyan layer): a blend of two red-sensitized (same as above) silver iodobromide emulsions: (i) the larger one(1.144×0.12, 4.1 mole % I) at 0.101 and (ii) a smaller one (0.997×0.114, 4.1 mole % I) at 0.732; gelatin at 1.29; C-1 at 0.392; DIR-1 at 0.015; MC-1 at 0.059.

Layer 4 (Fast cyan layer): a red-sensitized (same as above) tabular silver iodobromide emulsion (1.87×0.13, 4.1 mole % 1) at 0.926; C-1 at 0.226; DIR-1 at 0.027; DIR-2 at 0.048; MC-1 at 0.022; gelatin at 1.29.

Layer 5 (Interlayer): gelatin at 0.538; Dox scavenger (St-1) at 0.108; Cpd-3 at 0.0007.

Layer 6 (Slow magenta layer): a silver iodobromide emulsion sensitized with Dye Set 2 (GSD-1+GSD-2 at 4.5:1 by wt.): 0.671×0.12, 3% I at 0.334; magenta dye-forming coupler (M-1) at 0.301; masking coupler (MC-2) at 0.054; Cpd-3 at 0.0039; polystyrenesulfonate polymer (PSS-1) at 0.015; gelatin at 1.18.

Layer 7 (Mid magenta layer): a blend of two green sensitized (as above) silver iodobromide emulsions: (i) 1.144×0.12, 4.1 mole % iodide at 1.033 and (ii) 0.779×0.144, 4.1 mole % iodide at 0.592, M-1 at 0.140; MC-2 at 0.151; DIR-3 at 0.038; gelatin at 1.13.

Layer 8 (Fast magenta layer): a green sensitized (as above) tabular silver iodobromide (2.67×0.137, 4.1 mole % I) emulsion at 0.969; gelatin at 1.238; M-1 at 0.140; MC-2 at 0.054; DIR-4 at 0.032.

Layer 9 (Yellow filter layer): Dye-2 at 0.054; St-1 at 0.108; and gelatin at 0.645.

Layer 10 (Slow yellow layer): a blend of three tabular silver iodobromide emulsions sensitized with Dye Set 3 (BSD-1+BSD-2 at 1:1 by wt.): (i) 0.54×0.08, 1.3 mole I at 0.237, (ii) 0.77×0.14, 1.5 mole % I at 0.409 and (iii) 1.67×0.135, 4.1 mole % I at 0.452; gelatin at 2.05; yellow dye-forming coupler (Y-1) at 1.012; DIR-5 at 0.054; DIR-1 at 0.027; B-1 at 0.011; polymer latex (PL-1) at 0.041.

Layer 11 (Fast yellow layer): a blue sensitized (BSD-1) 3-D silver iodobromide emulsion of 1.02 radius, 9 mole % I at 0.614; Y-1 at 0.355; DIR-5 at 0.086; B-1 at 0.005; gelatin at 1.18.

Layer 12 (IV filter layer): gelatin at 0.699; silver bromide Lippman emulsion at 0.215; UV-1 at 0.108 and UV-2 at 0.108.

Layer 13 (Protective overcoat): gelatin at 0.882; colloidal silica at 0.108.

Hardener (bis(vinylsulfonyl)methane hardener at 1.80% of total gelatin weight), antifoggants (including 4-hydroxy-6-methyl-1,3,3a,7-tetraazaindene), surfactants, coating aids, emulsion addenda, sequestrants, lubricants, matte and tinting dyes were added to the appropriate layers as is common in the art. The following are the formulas for the employed compounds.

B-1

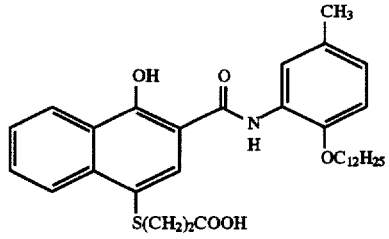

-continued
C-1:
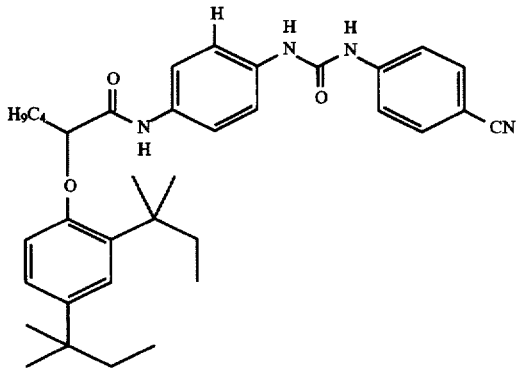
Cpd-1
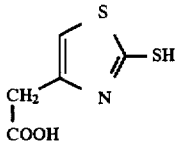
Cpd-2
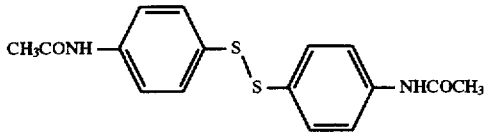
Cpd-3
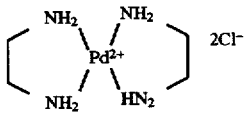
DIR-1:
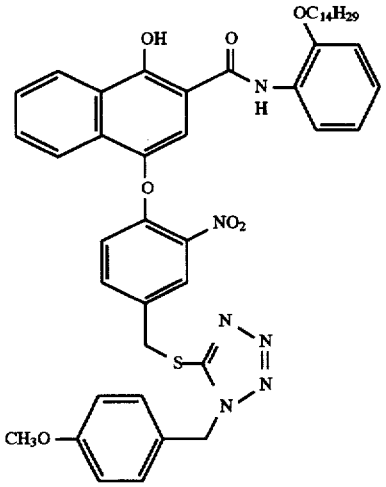
DIR-2:
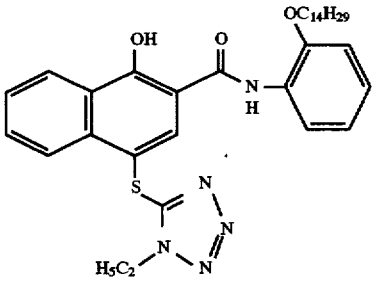

-continued
DIR-3:
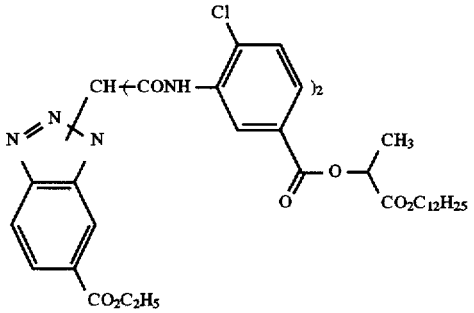
DIR-4:
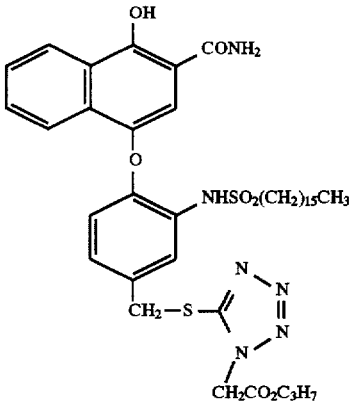
DIR-5:
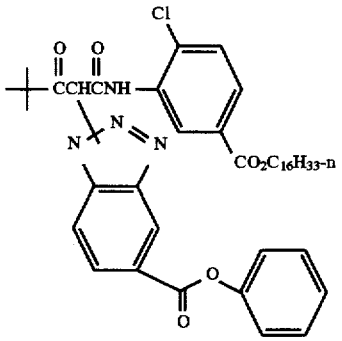
DIR-6:
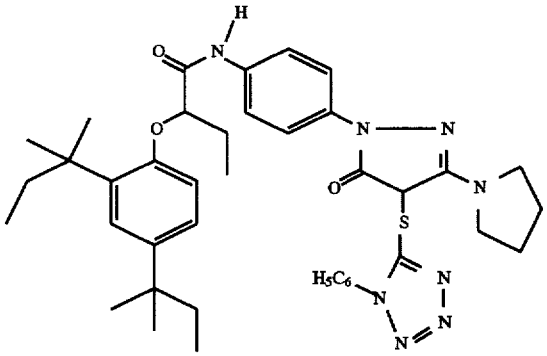

-continued
Dye-1:
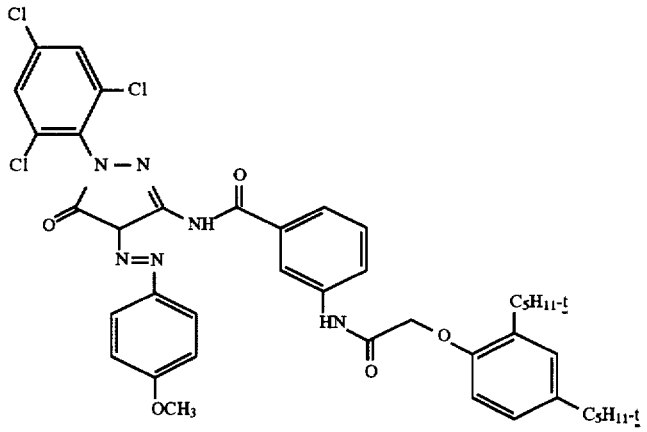
Dye-2:
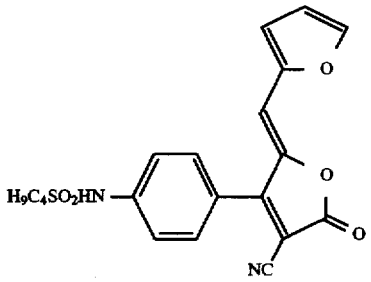
Dye-3:
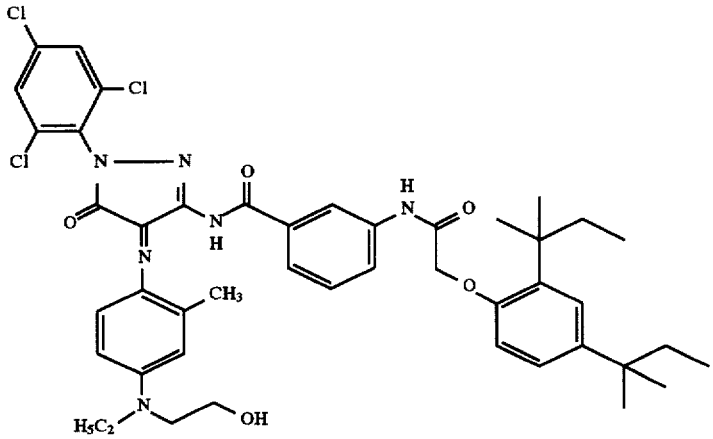
Dye-4:
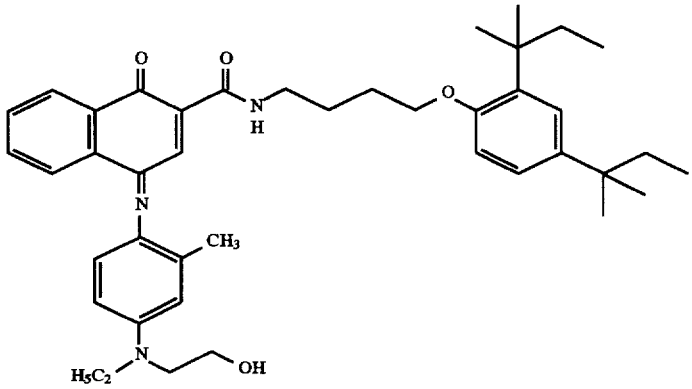

-continued
M-1
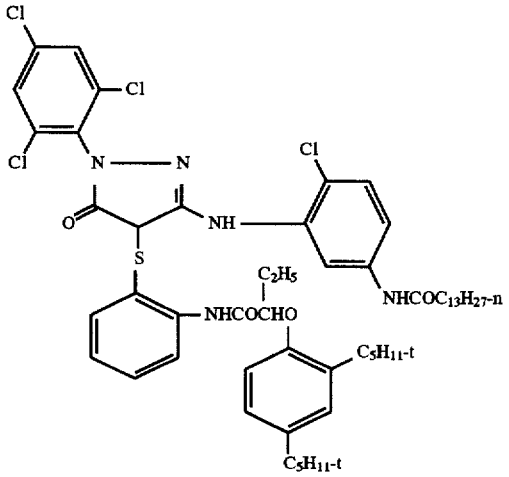
MC-1
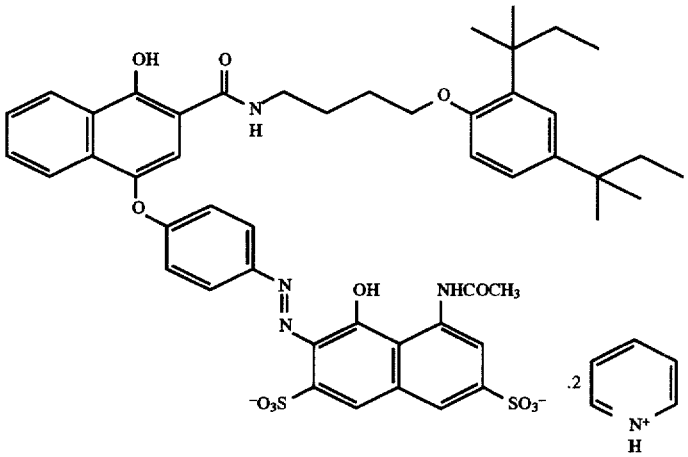
MC-2
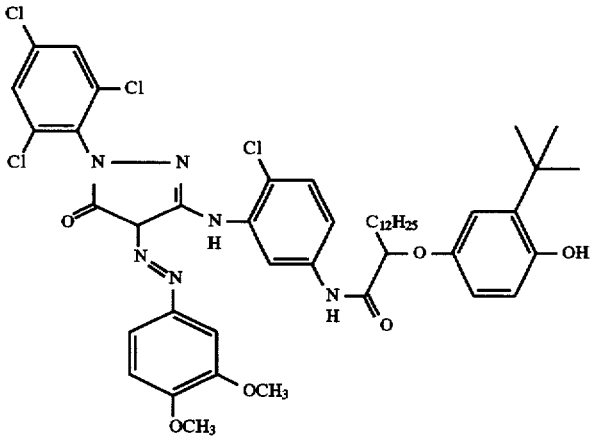
PL-1
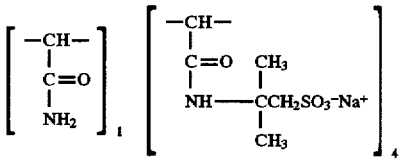
subscripts represent wt. proportion -continued
PSS-1
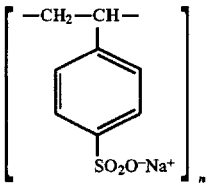
avg. mol. wt. = 536,000
St-1
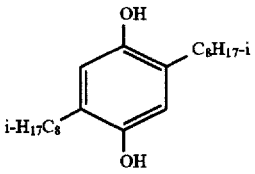
UV-1:
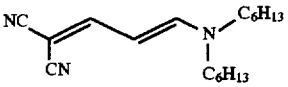
UV-2:
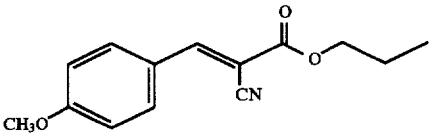
Y-1
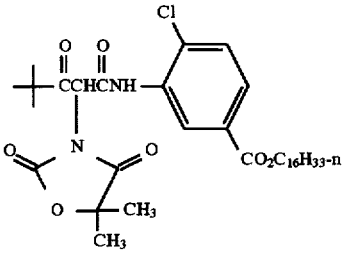
Dye Set 1: RSD-1:RSD-2 at 2:1
Dye Set 2: GSD-1:GSD-2 at 4.5:1
Dye Set 3: BSD-1:BSD-2 at 1:1
BSD-1
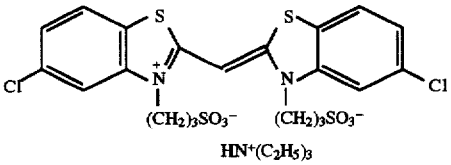
BSD-2
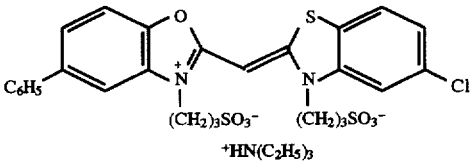
GSD-1
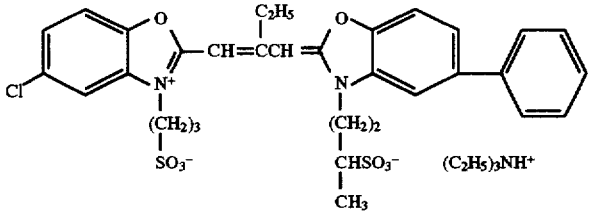

-continued

GSD-2

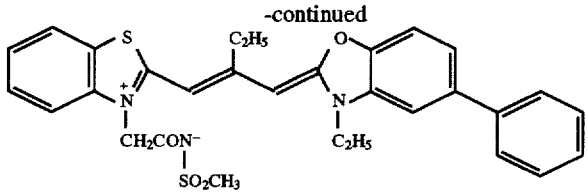

RSD-1

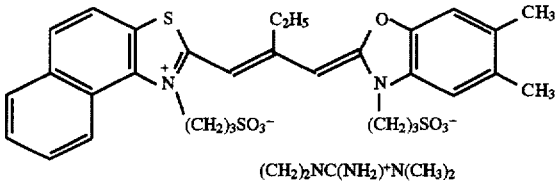

$(CH_2)_2NC(NH_2)^+N(CH_3)_2$

RSD-2

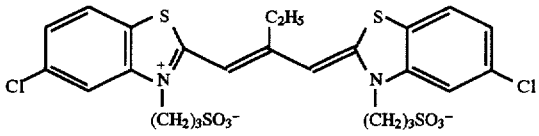

$HN^+(C_2H_5)_3$

The multilayer coatings were given a neutral exposure with 0–4 Status M density tablet of 0.2 neutral density increment steps with a sensitometer, processed in accordance with the Kodak Flexicolor C41 process, and H&D curves were plotted. Speed was measured at a density 0.15 above minimum density and reported in relative speed units where 100 relative speed units corresponds to 1.00 logE (where E represents exposure in lux-seconds) and where approximately 30 relative speed units corresponds to one stop (a doubling of light sensitivity). A gain of 3 units in relative speed units represents a significant increase in light sensitivity of 10%.

In order to determine the raw stock keeping characteristics of a film sample, the blue speed of a freshly prepared sample was measured and compared to that of an identical sample which had been stored for a period prior to testing. Since most of the sensitometric changes occur in the blue record, the blue speed was used as a measure of the impact of the invention. For each example, a table of blue speed is presented to depict the fresh result of samples containing both reductones and Lippmann emulsion in the most blue sensitive layer.

Color negative print film raw stock keeping tests were done either using a high temperature incubation oven (4 week of 38° C. at 50% RH), or extended ambient temperature keeping (3 months 26° C./50% RH). In addition, a latent image test was also done along with raw stock keeping—one week of latent image keeping followed by three weeks of raw stock keeping at 38° C./50% RH condition. Also tested was one month latent image keeping with two additional months of raw stock keeping at 26° C./50% RH.

The sensitometric curves of the kept film and reference conditions were plotted on a trilinear plot (See E. Goll and E. McCune, *Photofinishing Color Printing* available from E. Goll, 7859 Tabors Corners Road, Wayland, N.Y. 14572, "Chromatic Correction") to show the color balance movement due to the effect of keeping. The color balanced fresh film would be generally situated at or near the center of the trilinear plot. Any deviation from the fresh position caused by keeping would indicate a color balance shift. The shifting of color balance would induce color error—an undesirable situation. The less the color shift due to the keeping effect, the less the color correction, or chromatic correction, the better the film will be printed correctly.

Since the main purpose of color negative print film is to form a reflective color print via optical printing using a color printer, we measured the movement in color balance as a function of keeping with any movement being negative. The standard processing laboratories' printer color correction measure, Color Button (a deviation of 0.025 density unit in a tri-lineal plot) (See E. Goll and E. McCune, cited above, about Color Buttons) was used as the base of the measurement for the keeping experiments. A keeping impact of −1 from the reference coating corresponds to one Color Button shift in chromatic space.

EXAMPLE-1

10.8 mg/m$^2$ of I-1 was coated in four different locations of the reference multilayer format in order to observe its impact on fresh speed and keeping. Aside from the reference coating which did not have I-1 added, the four locations were Layer-1 (Anti-halation layer), Layer-6 (Slow Magenta layer), Layer-10 (Slow Yellow layer) and Layer-11 (Fast Yellow layer). Regardless of where I-1 was introduced, the samples had essentially the same effect on fresh sensitometry—a net loss of 9 to 10 speed units of blue speed was observed. Even though these compounds served to improve raw stock keeping, the compounds had a prohibitive negative impact on blue speed. This experiment also indicated that the existence of I-1 in the film element was a very mobile situation. Location of the compound did not matter.

EXAMPLE-2

Multilayer coatings were prepared as in the reference format and also with the inclusion of 10.7 mg/m$^2$ of compound I-1 in Layer-10. The fresh blue speed results were expressed in the amount of change in relative blue speed, raw stock keeping (4 wks 100/50), and latent image keeping (3+1 wks 100/50 LIK) results were expressed in changes in Color Buttons. The data are listed in Table 1.

TABLE 1

| Examples | Type | Relative Fresh Blue Speed | Raw stock Keeping (CB) | Latent Image Keeping (CB) |
|---|---|---|---|---|
| 2-a | Comp | 0 | 0 | 0 |
| 2-b | +I-1 (Comp) | −9.6 | −1 | −1 |

EXAMPLE-3

Multilayer coatings were prepared as in the reference format (a) and also with the inclusion of 3.2 mg/m$^2$ of I-1 in Layer-10 (Slow Yellow layer) with(b) or without(c) 54 mg/m$^2$ of Lippmann emulsion (0.051 radius) in Layer-11 (Fast Yellow layer) were prepared. The layer comprised 8.1 wt % of grains less that 0.2 micrometers equivalent circular diameter. The fresh blue speed, raw stock keeping and latent image keeping were expressed as in Example 1. The data are shown in Table 2.

TABLE 2

| Examples | Type | Relative Fresh Blue Speed | Raw stock Keeping (CB) | Latent Image Keeping (CB) |
|---|---|---|---|---|
| 3-a | Comp | 0 | −1 | −1 |
| 3-b | +I-1 and Lippmann Inv | +1.8 | 0 | 0 |
| 3-c | +I-1 Comp | −5.0 | 0 | 0 |

Table 2 shows that 5 units of speed are lost when I-1 is added but when the Lippmann emulsion is included in Layer-11(Fast Yellow layer), the loss is more than overcome without any degradation in the raw stock or latent image keeping.

EXAMPLE-4

Multilayer coatings were prepared as in the reference format and also with addition of Lippmann emulsion at 54 mg/m$^2$ in layer-11(Fast Yellow layer) and 3.2 mg/m$^2$ of I-2, or 5.4 mg/m$^2$ of I-2(c). The layers with Lippmann comprised 8.1 wt % of grains less that 0.2 micrometers equivalent circular diameter. The data are shown in Table 3.

TABLE 3

| Examples | Type | Relative Fresh Blue Speed | Raw stock Keeping (CB) | Latent Image Keeping (CB) |
|---|---|---|---|---|
| 4-a | Comp | 0 | 0 | −1 |
| 4-b | +I-1 and Lippmann Inv | +4.9 | 0 | 0 |
| 4-c | +I-1 and Lippmann Inv | +4 | 0 | 0 |

Table 3 shows that improved speed with equal or better raw stock and latent image keeping are obtained with the inventive elements.

EXAMPLE-5

Multilayer coatings were prepared in the reference format (a). A second coating was prepared as (a) but with addition of Lippmann emulsion at 54mg/m$^2$ in Layer-11(Fast Yellow layer) (b). The third coating were prepared as (b) but with addition of 3.2 mg/m$^2$ of I-1 in Layer-10(c), and the fourth coating were prepared as (a) but addition of 3.2 mg/m$^2$ of I-1 (d). The layers with Lippmann comprised 8.1 wt % of grains less that 0.2 micrometers equivalent circular diameter. The results are shown in Table 4.

TABLE 4

| Examples | Type | I-1 | Lippmann Emulsion | Fresh Blue Speed |
|---|---|---|---|---|
| 5-a | Comp | − | − | 364 |
| 5-b | Comp | − | + | 370 |
| 5-c | Inv | + | + | 366 |
| 5-d | Comp | + | − | 357 |

Addition of the fine grain Lippmann emulsion to reference format (a) gained 6 blue speed units (b–a), while addition of I-1 to the reference format resulted in a loss of 7 blue speed units (a–d). From this it would be reasonable to conclude that the conjoint addition of both components would result in a net loss of one unit (6–7=−1.) However, when I-1 was added to the coating that contained the fine grain Lippmann emulsion, the expected loss of 1 blue speed unit vs the reference coating (a) was not realized. Instead, there was a gain of 2 speed units (c–a). It appears that the interaction of I-1 and the fine grain Lippmann emulsion resulted in unexpected 3 blue speed units while at the same time improving keeping. Such an increase represents 0.1 stops or a 10% increase in the low light sensitivity of the blue light sensitive layer, which is a very significant improvement.

EXAMPLE-6

Multilayer coatings were prepared as in the reference format but the Fast Yellow 3D emulsion in Layer-11 was finished at a different temperature and dye level(a). The second coating was prepared as (a) but with addition of Lippmann emulsion at 54 mg/m$^2$ in Layer-11 (b). The third coating was prepared as (b) but with the further addition of 3.2 mg/m$^2$ of I-1 in Layer-10 (c), and the fourth coating were prepared as (a) but addition of 3.2 mg/m$^2$ of I-1. The layers with Lippmann comprised 8.1 wt % of grains less that 0.2 micrometers equivalent circular diameter. The results are shown in Table 5.

TABLE 5

| Examples | Type | I-1 | Lippmann Emulsion | Fresh Blue Speed |
|---|---|---|---|---|
| 6-a | Comp | − | − | 363 |
| 6-b | Comp | − | + | 369 |
| 6-c | Inv | + | + | 365 |
| 6-d | Comp | + | − | 357 |

Similar to Example-5, the addition of Lippmann emulsion gained 6 blue speed units (b–a), while addition of I-1 to the reference format resulted in loss of 6 blue speed units (d–a) However, when the I-1 was added to the coating that contained the Lippmann emulsion, the net effect was an increase in 2 speed units. (c–a). Again, it appeared that the interaction of I-1 and Lippmann emulsion resulted in improved speed. This combined with the data of Tables 2 and 3 which show equal or better raw stock and/or latent image keeping for the inventive element provide an advantageous result.

EXAMPLE 7

A further multilayer color element was prepared as follows:

Layer 1 (Antihalation layer): black colloidal silver at 0.108; gelatin at 2.153; sulfuric acid (0.2N) at 0.0028; Triton X-200® (Rohm and Haas) at 0.053; hexasodium salt of metaphosphoric acid at 0.032; disodium salt of 3,5-disulfocatechol at 0.215; Dye-1 at 0.0753; Dye-3 at 0.004, Dye-4 at 0.031, St-1 at 0.161; Cpd-1 at 0.0005; Cpd-2 at 0.0024.

Layer 2 (Slow cyan layer): a blend of two silver iodobromide emulsions sensitized with Dye Set 1 (CSD-1+CSD-2 at 2:1 by wt.): (i) a small tabular emulsion (0.532×0.122, 4.1 mole % I) at 0.441 and (ii) a very small tabular grain emulsion (0.53×0.08, 1.5 mole % I) at 0.506; gelatin at 1.67; cyan dye-forming coupler C-1 at 0.370; bleach accelerator releasing coupler(B-1) at 0.075; and cyan inhibitor releasing coupler (DIR-1) at 0.0151.

Layer 3 (Mid cyan layer): a red-sensitized (same as above) silver iodobromide emulsion (1.44×0.12, 4.1 mole % I) at 1.173; gelatin at 1.29; C-1 at 0.258; DIR-1 at 0.015; MC-1 at 0.059.

Layer 4 (Fast cyan layer): a red-sensitized (same as above) tabular silver iodobromide emulsion (2.83×0.13, 4.1 mole % I) at 0.947; C-1 at 0.280; DIR-1 at 0.027; DIR-2 at 0.048; MC-1 at 0.022; gelatin at 1.29.

Layer 5 (Interlayer): gelatin at 0.538; Dox scavenger (sT-1) at 0.108; Cpd-3 AT 0.0007.

Layer 6 (Slow magenta layer): a blend of two silver iodobromide emulsions sensitized with Dye Set 2 (GSD-1+GSD-2 at 4.5:1 by wt.): (I) 0.779×0.144, 4.1 mole % I at 0.151, 0.671×0.12, 3% I at 0.301; magenta dye-forming coupler (M-1) at 0.312; masking coupler (MC-2) at 0.054; Cpd-3 at 0.0039; Polystyrenesulfonate polymer at 0.015; gelatin at 1.18.

Layer 7 (Mid magenta layer): a blend of two green sensitized (as above) silver iodobromide emulsions: (i) 1.144×0.12, 4.1 mole % iodide at 1.184 and (ii) 0.779×0.144, 4.1 mole % iodie at 0.108, M-1 at 0.097; MC-2 at 0.118; DIR-3 at 0.032; gelatin at 1.13.

Layer 8 (Fast magenta layer): a green sensitized (as above) tabular silver iodobromide (2.67×0.137, 4.1 mole % I) emulsion at 0.883; gelatin at 1.238; M-1 at 0.151; MC-2 at 0.054; DIR-4 at 0.032, DIR-6 at 0.003.

Layer 9 (Yellow filter layer): Dye-2 at 0.054; St-1 at 0.108; and gelatin at 0.645.

Layer 10 (Slow yellow layer): a blend of three tabular silver iodobromide emulsions sensitized with Dye Set 3 (BSD-1+BSD-2 at 1:1 by wt.): (i) 0.54×0.08, 1.3 mole I at 0.463, (ii) 0.77×0.14, 1.5 mole % I at 0.301 and (iii) 1.67×0.135, 4.1 mole % I at 0.108; gelatin at 2.05; yellow dye-forming coupler (Y-1) at 1.033; DIR-5 at 0.054; DIR-1 at 0.027; C-1 at 0.027, B-1 at 0.011; Awna polymer at 0.041.

Layer 11 (Fast yellow layer): a blue sensitized (BSD-1) 3-D silver iodobromide emulsion of 1.02 radius, 9 mole % I at 0.646; a silver bromide Lippmann emulsion (0.051 radius) of 0.054 was mixed with the larger emulsion; Y-1 at 0.355; DIR-5 at 0.086; B-1 at 0.005; gelatin at 1.18.

Layer 12 (UV filter layer): gelatin at 0.699; silver bromide Lippman emulsion at 0.215; UV-1 at 0.108 and UV-2 at 0.108.

Layer 13 (Protective overcoat): gelatin at 0.882; colloidal silica at 0.108.

Hardener (bis(vinylsulfonyl)methane hardener at 1.80% of total gelatin weight), antifoggants (including 4-hydroxy-6-methyl-1,3,3a,7-tetraazaindene), surfactants, coating aids, emulsion addenda, sequestrants, lubricants, matte s were added to the appropriate layers as is common in the art.

Both Raw Stock Keeping and Latent Imaging Keeping of this coating resulted in less than one Color Button (CB) movement in the tri-linear plots which is an excellent result.

What is claimed is:

1. A multicolor photographic element comprising a support bearing at least two silver halide emulsion layers having different sensitivities to blue light, a silver halide emulsion layer sensitive to green light, and a silver halide emulsion layer sensitive to red light, wherein:

(1) the element comprises a compound of formula (I):

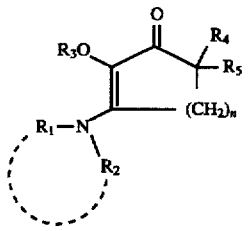

(I)

wherein $R_1$ and $R_2$ independently represent H, an alkyl group or an aryl group, provided that $R_1$ and $R_2$ may be joined to form a ring;

$R_3$ is selected from the group consisting of H, alkyl, aryl, and acyl groups;

$R_4$ and $R_5$ are independently selected from the group consisting of H, OH, alkyl, and aryl groups;

n is 1 or 2;

and (2) the silver halide emulsion layer of the element that is most sensitive to blue light contains a silver halide grain population such that from 3 to 20 wt % of the total silver halide grains in the emulsion layer have a size (equivalent circular diameter) less than 0.2 micrometers.

2. The element of claim 1 wherein $R^1$ and $R^2$ are joined to form a ring.

3. The element of claim 2 wherein the ring has the formula:

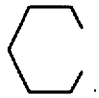

4. The element of claim 2 wherein the ring has the formula:

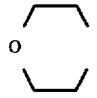

5. The element of claim 1 wherein $R_1$ and $R_2$ are independently selected alkyl groups of 1 to 6 carbon atoms.

6. The element of claim 5 wherein $R_1$ and $R_2$ are methyl groups.

7. The element of claim 1 wherein the laydown of compound (I) is from 0.001 to 21.5 mg/m$^2$.

8. The element of claim 7 wherein the laydown of compound (I) is from 0.108 to 10.8 mg/m$^2$.

9. The element of claim 8 wherein the laydown of compound (I) is from 3 to 8 mg/m$^2$.

10. The element of claim 1 wherein the support is transparent.

11. The element of claim 1 which is packaged with instructions to process color negative.

12. The element of claim 1 wherein the silver halide emulsion layer of the element that is most sensitive to blue light contains a silver halide grain population such that from 5 to 15 wt % of the total silver halide grains in the emulsion layer have a size (equivalent circular diameter) less than 0.2 micrometers.

13. The element of claim 1 wherein compound (I) is selected from the group consisting of the following:

I-1

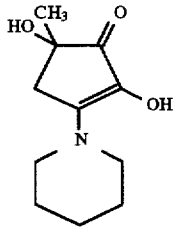

I-2

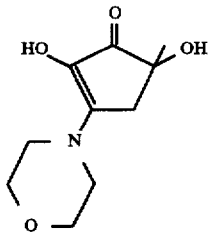

I-3

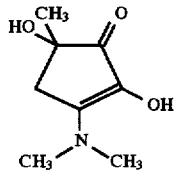

I-4

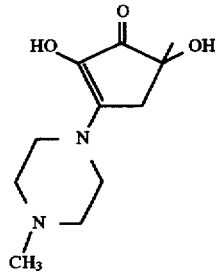

I-5

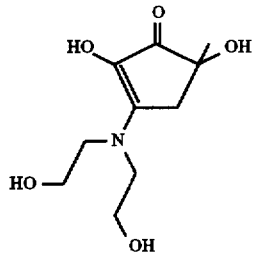

-continued

I-6

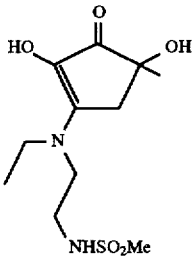

I-7

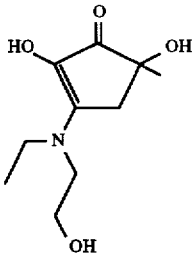

I-8

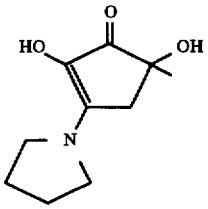

I-9

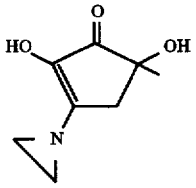

I-10

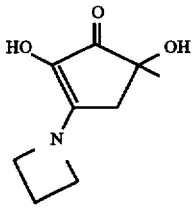

I-11

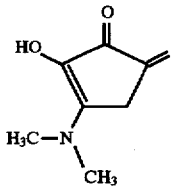

I-12

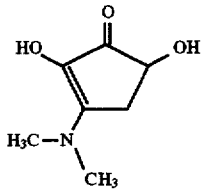

-continued
I-13
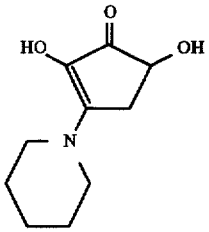
I-14
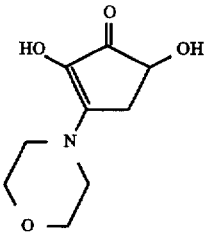
I-15
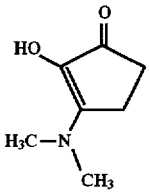
I-16
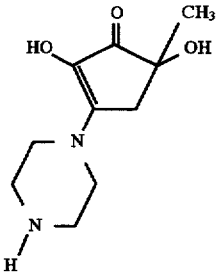
-continued
I-17
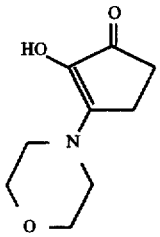
I-18
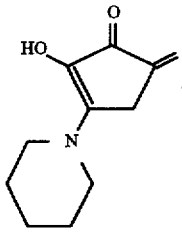
, and
I-19
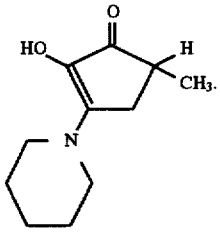
14. A process for forming an image in an element as described in claim 1 after it has been exposed to light comprising contacting the element with a color developing agent.
15. The process of claim 14 wherein the color developing agent is a p-phenylenediamine.
* * * * *